United States Patent [19]

Yamamoto et al.

[11] 4,101,797

[45] Jul. 18, 1978

[54] OFF CENTER ELECTRODE SPARK PLUG

[75] Inventors: Iwao Yamamoto, No. 1-13, Shirasagi, 1-chome, Nakano-ku; Moriro Koga, both of Tokyo, Japan

[73] Assignee: said Iwao Yamamoto, by said Moriro Koga, Tokyo, Japan; a part interest

[21] Appl. No.: 751,530

[22] Filed: Dec. 16, 1976

[30] Foreign Application Priority Data

Dec. 18, 1975 [JP] Japan ..... 50-151402
Sep. 1, 1976 [JP] Japan ..... 51-104667

[51] Int. Cl.[2] ..... H01T 13/20
[52] U.S. Cl. ..... 313/141; 123/169 EL
[58] Field of Search ..... 313/141, 142; 123/169 EL, 169 E

[56] References Cited

U.S. PATENT DOCUMENTS

| | | | |
|---|---|---|---|
| 1,279,974 | 9/1918 | Blomster et al. | 313/141 X |
| 1,353,785 | 9/1920 | Platt | 313/141 X |
| 1,354,945 | 10/1920 | Blomster et al. | 313/141 |
| 2,159,791 | 5/1939 | Fruth | 313/142 |
| 2,324,616 | 7/1943 | D'Elia | 313/141 |

*Primary Examiner*—Siegfried H. Grimm
*Attorney, Agent, or Firm*—Holman & Stern

[57] ABSTRACT

Disclosed is an improved spark plug in which a projection is provided at the end face of a central electrode and an earthing electrode is fixed by projection weld to the end surface of a main body to form a small gap between an outer angular portion of said projection and an underside angular portion of the nose of said earthing electrode, and which makes it possible to use a dilute air/fuel mixture and, hence, to decrease an amount of harmful exhaust gases.

2 Claims, 4 Drawing Figures

OFF CENTER ELECTRODE SPARK PLUG

BACKGROUND OF THE INVENTION

The present invention is concerned with an improved spark plug for use in internal combustion engines employing gasoline.

SUMMARY OF THE INVENTION

According to the present invention, a projection is provided at the end face of an central electrode and an earthing electrode is fixed by projection weld to a main body to form a small gap between an outer angular portion of the projection and an underside angular portion of the nose of the earthing electrode. The spark plug thus constructed prevents a discharge generating no flame or a faint discharge from being produced between both electrodes and thus prevents a voltage between both electrodes from being lowered so that a strong spark discharge is assured between the outer angular portion of the projection of the central electrode and the underside angular portion of the ground electrode. The complete combustion takes place in internal combustion engines and, hence, leads to a substantial decrease in a quantity of harmful gases such as CO (carbon monoxide) gas, HC (hydrocarbon) gas, $NO_x$ (nitrogen oxide compound) gas or the like, which are contained in exhaust gases. Consequently, an air pollution due to the exhaust gases is substantially eliminated.

The prior art spark plugs have a central electrode and an earthing electrode arranged in such a manner that a small gap is provided just above the end face of the former. Accordingly, such plugs merely produce numerous discharges affording no flame or faint spark discharges between the periphery of the nose of the central electrode and the angular portion of the earthing electrode thereby lowering a voltage between both electrodes, since a high voltage current generally assures a discharge between the nose portions, but is not apt to produce a discharge between planes. Consequently, a spark discharge effecting combustion of air/fuel mixtures is attenuated, resulting in incomplete combustion of said mixtures. In order to avoid such incomplete combustion, an air/fuel mixture rich in fuel has to be supplied, leading to an increase in an amount of CO (carbon monoxide) gas, HC (hydrocarbon) gas, $NO_x$ (nitrogen oxide compound) gas and the like in the exhaust gases. Thus, the prior art spark plugs are disadvantageous in that they cause an air pollution due to such exhaust gases.

BRIEF DESCRIPTION OF THE DRAWINGS

The accompanying drawings illustrate two embodiments of the present invention, wherein.

DETAILED DESCRIPTION OF A PREFERRED EMBODIMENT

Figure 1:
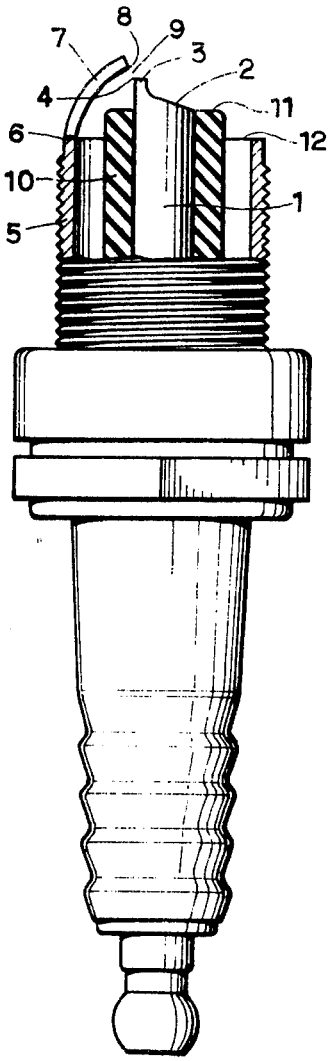
FIG. 1 is an enlarged front view partly in section of the one embodiment.
Figure 2:
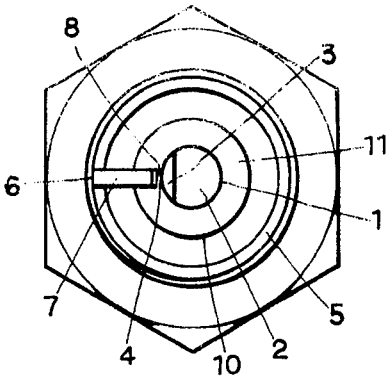
FIG. 2 is a plan view thereof.

Turning now to FIGS. 1 and 2, there is shown one preferred form in which a projection 3 is provided at one side of the end face 2 of a central electrode 1, and an earthing electrode 7 is fixed by projection weld to the end face 6 at the projection 3 side of a main body 5 to form a small gap in the order of 0.5 to 2 mm, dependent upon a voltage applied to the central electrode, between an outer angular portion of the projection 3 and an underside angular portion 8 of the nose of the electrode 7. In order to avoid a discharge between the central electrode 1 and the main body 5, especially the inner angular portion of the upper end thereof, an isulating member for receivably enclosing the central electrode 1 has an upper end face 11 protruding upwardly form the upper end face 12 of the main body.

Figure 3:
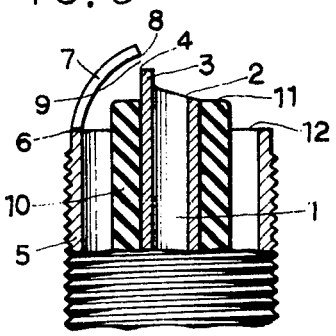
FIG. 3 is a partially enlarged plan view partly in section of the other and FIG. 4 is a plan view thereof.
Figure 4:
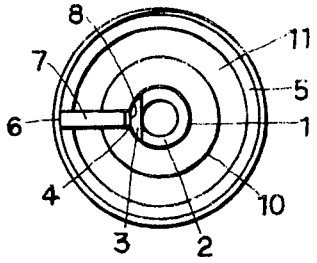

An alternate preferred embodiment shown in FIGS. 3 and 4 has the same construction as that of FIGS. 1 and 2, except that a pipe-like central electrode 1 is used and a projection 3 is provided at one side of the end face 2 thereof. The same parts as in the embodiment shown in FIGS. 1 and 2 are accordingly indicated by like reference numerals.

Since the portions except for the outer angular portion 4 of the projection 3 of the central electrode are sufficiently spaced from the underside angular portion 8 of the earthing electrode 7, a discharge generating no flame or a faint spark discharge are not virtually produced between the electrodes, except between the outer angular portion 4 of the projection 3 of the central electrode 1 and the underside angular portion 8 of the ground electrode 7. Since the absence of such a discharge does not lower a voltage between both electrodes, a strong spark discharge is generated only between the outer angular portion 4 of the projection 3 of the central electrode 1 and the underside angular portion 8 of the nose of the ground electrode 7. Due to the generation of this strong spark discharge, a dilute air/fuel misture with an air/fuel ratio being 18 – 24/1 is completely combusted to attain a normal developed power. Thus, the complete combustion of a dilute air/fuel mixture leads to a decrease in an amount of harmful gases such as CO (carbon monoxide) gas, HC (hydrocarbon) gas, $NO_x$ (nitrogen oxide compound) gas or the like which are contained in the exhaust gases, and, hence remarkably eliminates an air pollution due to the exhaust gases.

What is claimed is:

1. A spark plug in which an arcuate projection is provided at the end face of a central electrode said arcuate projection comprised of an off-center extension of said central electrode, an insulator separating said central electrode from a main body having an end surface, said insulator interposed directly between said electrode and said body with only said arcuate projection exposed to said main body, and an arcuate earthing electrode is fixed by a projection weld to the end surface of said main body to form and maintain a small gap between an outer arcuate portion of said extension and an underside angular portion of the nose of said earthing electrode.

2. A spark plug as claimed in claim 1 wherein said central electrode has a tubular shape.

* * * * *